United States Patent [19]

Wanke

[11] 4,004,717

[45] Jan. 25, 1977

[54] PRESSURE FED LIQUID DISPENSER

[75] Inventor: William L. Wanke, Kokomo, Ind.

[73] Assignee: General Motors Corporation, Detroit, Mich.

[22] Filed: Nov. 28, 1975

[21] Appl. No.: 635,916

[52] U.S. Cl. ..... 222/255; 222/571

[51] Int. Cl.[2] ..... B05B 1/28

[58] Field of Search ..... 222/333, 255, 571; 141/115, 117, 120

[56] References Cited

FOREIGN PATENTS OR APPLICATIONS 482,247 4/1952 Canada ..... 141/117

*Primary Examiner*—Stanley H. Tollberg

*Attorney, Agent, or Firm*—Ronald L. Phillips

[57] ABSTRACT

A liquid dispenser having one piston and cylinder for feeding the liquid and a larger piston and cylinder co-operating with a valve to provide aspirator action to eliminate dripping and break stringing.

2 Claims, 3 Drawing Figures

PRESSURE FED LIQUID DISPENSER

This invention relates to a liquid dispenser and more particularly to a liquid dispenser that does not drip and breaks stringing.

In the accurate dispensing of liquids, dripping is, of course, to be avoided. And there is the further problem with dispensing highly viscous material such as an adhesive since this material tends to string and thereby make it more difficult to provide an accurately dispensed amount.

According to the present invention there is provided a dual piston and cylinder arrangement of different displacements that cooperates with a single spring-biased valve. The small displacement piston serves to dispense or eject a precise amount of the liquid and the larger displacement piston provides aspirator action at the termination of the dispensing operation to prevent dripping and break any stringing of the material.

An object of the present invention is to provide a new and improved liquid dispenser.

Another object of the present invention is to provide in a liquid dispenser a pair of different displacement piston and cylinder arrangements which cooperate with a valve to dispense a precise amount of the liquid and immediately thereafter provide suction action to prevent dripping and break any stringing of the liquid.

Another object is to provide in a liquid dispenser a small displacement device that dispenses a predetermined amount of the liquid through a check valve and out through the dispenser nozzle and a large displacement device that on termination of the dispensing action and closure of the valve provides a sucking action on the liquid then in the nozzle to prevent dripping and also break any string of liquid depending from the nozzle.

These and other objects and advantages of the present invention will be more apparent from the following description and drawing in which.

Figure 1:
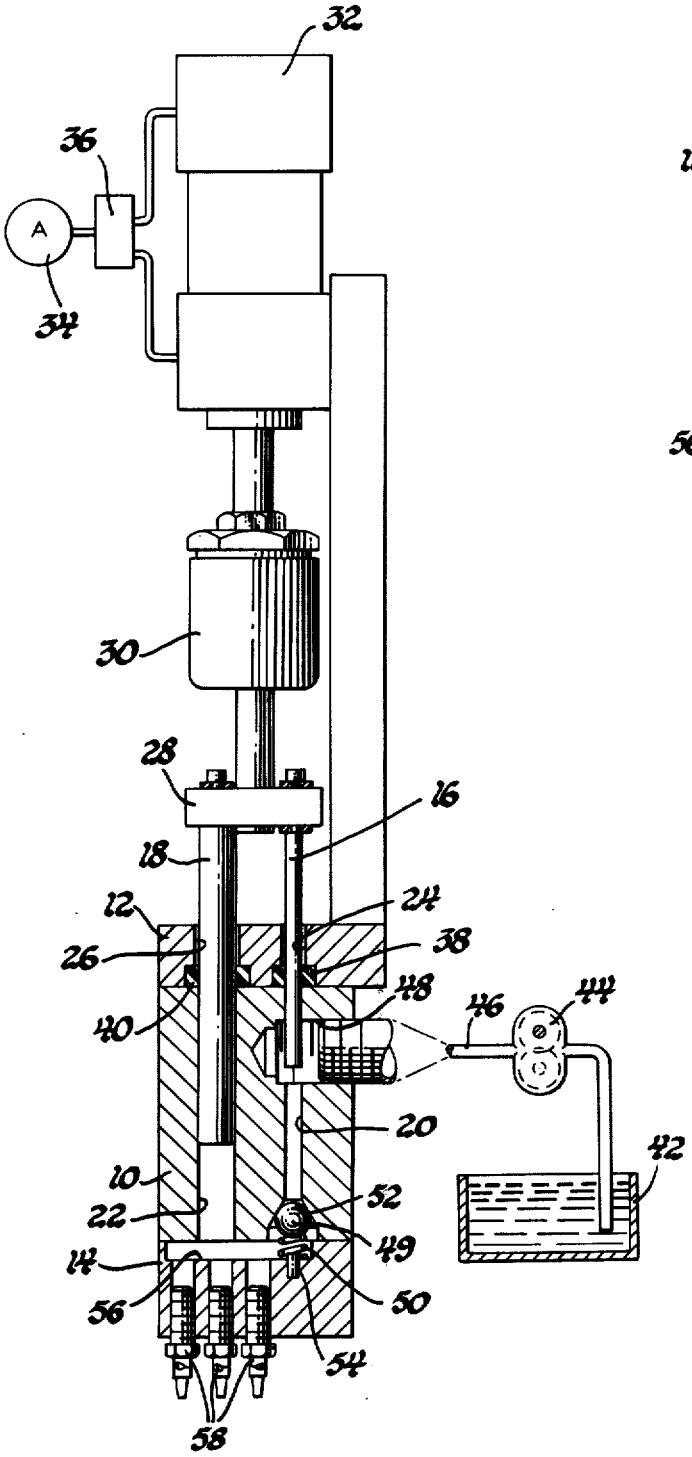
FIG. 1 is an elevational view with some parts shown in section and some parts shown diagrammatically of a liquid dispenser according to the present invention and with the dispenser shown in its fill condition.

Referring to FIG. 1, there is shown a preferred embodiment of the liquid dispenser according to the present invention as adapted to dispense adhesive through a multi-nozzle arrangement. In the particular application the dispenser is for use in meeting the requirements of dispensing six dots of 0.030 grams of Dow Corning 96-083 two part silicone adhesive onto an aluminum backplate of an automotive engine ignition assembly. The dispenser comprises a cylinder block 10 having a cap 12 and a distribution head 14 secured to its respective upper and lower ends. A dispenser piston 16 and an aspirator piston 18 in the form of simple solid cylinders are mounted in parallel, accommodating cylinders 20 and 22 formed in the cylinder block. The upper ends of the two pistons 16 and 18 extend upwardly and freely through bores 24 and 26 in the cap 12 and are connected above the cap by a plate 28 for joint reciprocable movement in their respective bores. The plate 28 is in turn connected by an axially adjustable coupling 30 to an air-cylinder 32. The ends of the cylinder 32 are alternately supplied with air pressure from a supply 34 and exhausted under the control of a valve 36 to move the pistons 16 and 18 up and down through a predetermined stroke which is adjustable by the coupling 30. The upper ends of the cylinders 20 and 22 are sealed by gaskets 38 and 40 which are mounted in annular recesses in the interface of the cap 12 and sealingly engage the respective pistons 16 and 18.

The liquid to be dispensed (in this case, silicone adhesive) is stored in a reservoir 42 and is delivered under a relatively low pressure, e.g. 40 psi, by a pump 44 and through a line 46 to an inlet port 48 in the cylinder block. The inlet port 48 intersects at right angles with the dispenser cylinder 20 near its under end so that the dispenser piston 16 clears or opens this port to the cylinder 20 at the top of its stroke as shown in FIG. 1. At the lower end of the dispenser cylinder 20 there is provided a ball valve 49 which is biased by a spring 50 to engage a conical seat 52 formed in the bottom end of this cylinder, the spring 50 being located by a pin 54 press-fitted in a hole in the bottom of a cavity 56 in the interface of distribution head 14. The aspirator cylinder 22 is, on the other hand, continuously open at its lower end below the aspirator piston 18 to the cavity 56 in the distribution head. The cavity 56 is continuously open to one or more dispenser nozzles 58, in this case six, threaded to the bottom of the distribution head.

The dispenser piston 16 and cylinder 20 have a substantially smaller diameter than the aspirator piston 18 and cylinder 22 and these arrangements respectively provide a small displacement dispenser section and a large displacement aspirator or suction section which cooperate with the spring-biased check valve 49 to provide precise dispensing of the liquid, in this case an adhesive, without dripping and/or stringing of the material.

Figure 2:
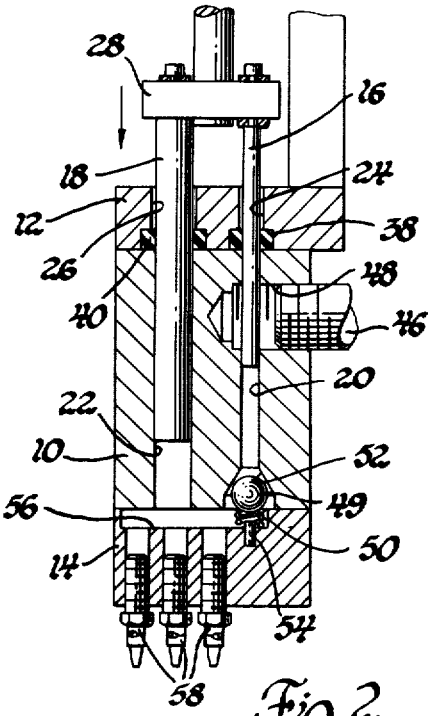
FIG. 2 shows the dispenser in its dispensing condition.
Figure 3:
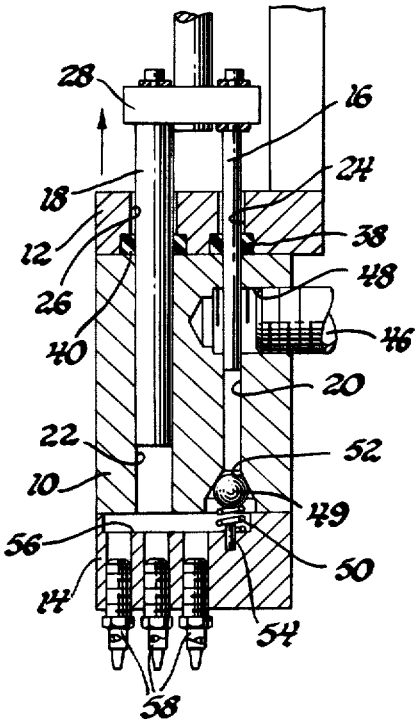
FIG. 3 shows the dispenser in its anti-drip/anti-stringing condition.

Describing now a typical operation of the device, the pistons 16 and 18 are initially raised by the air cylinder 32 to the position shown in FIG. 1 where they are at the top of their stroke. In this position the dispenser piston 16 clears the inlet port 48 and adhesive under pressure is delivered therethrough to fill the cylinder 20 below the piston, the check valve 49 being closed against the inlet or charge pressure by spring 50 to prevent flow therepast to the distribution head and its nozzles. With the cylinder 20 then fully charged, the air cylinder 32 is operated to push these two pistons 16 and 18 downward. Upon downward movement the dispenser piston 16 closes the cylinder 20 below the inlet 48 as shown in FIG. 2 and forces the trapped adhesive out past the check valve 49 and toward the nozzles 58 while the suction piston 18 is also descending and this action continues until the pistons reach the bottom of their stroke. Then on operation of the air cylinder 32 to retract the pistons 16 and 18, the aspirator cylinder 22 because of its larger displacement sucks back a portion of the adhesive to fill this chamber below this piston 18 while the check valve 49 then is closed under the force of its spring 50 as shown in FIG. 3 to prevent any adhesive from also being sucked back into the dispenser cylinder 20. A partial void is thus created within the distribution head which thereby prevents dripping from the nozzles 58 and is effective to break any string of material that was dispensed through the nozzles. The dispenser is then primed and on any subsequent repeat of this operation, the aspirator cylinder will push back the adhesive originally sucked back and the amount dispensed is the precise volume displaced by the dispenser cylinder 20 which can be varied by varying the stroke and/or the diameter of the dispenser piston and cylinder.

The above preferred embodiment is illustrative of the invention which may be modified within the scope of the appended claims.

I claim:

1. A liquid dispensing device comprising large and small variable displacement means, an inlet port for delivering a liquid under a charge pressure to said small variable displacement means, a dispensing nozzle, a check valve for permitting liquid flows from said small variable displacement means to said nozzle at pressures above said charge pressure and preventing reverse flow, said large variable displacement means continuously connected to said nozzle, and means for operating said small variable displacement means to open said inlet port so that liquid under pressure is then delivered to fill said small variable displacement means and then close off said inlet port and jointly decrease the displacement of both said variable displacement means to force liquid in said small variable displacement means through said check valve and out said nozzle and then jointly increase the displacement of both said variable displacement means, means urging the check valve into closed position when the displacement of both displacement means is increasing whereby the check valve then closes while the liquid still in said nozzle is suctioned by the expanding large variable displacement means to thereby prevent dripping from the nozzle and also break any string of the liquid dispensed from the nozzle.

2. A liquid dispensing device comprising a small diameter cylinder, a large diameter cylinder, an inlet port for delivering a liquid under a charge pressure to said small diameter cylinder, a dispensing nozzle, a check valve for permitting liquid flow from said small diameter cylinder to said nozzle at pressures above the charge pressure and preventing reverse flow, said large diameter cylinder continuously connected to said nozzle, small and large diameter pistons slidably mounted in the respective small and large diameter cylinders, and means for positioning said small diameter piston to open said inlet port so that liquid under pressure is then delivered to fill said small diameter cylinder and then jointly moving said pistons in one direction so that said small diameter piston closes off said inlet port and forces the liquid in said small diameter cylinder through said check valve and out said nozzle and then jointly moving said pistons in the opposite direction means urging the check valve into closed position upon said opposite direction movement, whereby the check valve then closes said nozzle to said small diameter cylinder while the liquid still in said nozzle is suctioned by the expanding space in the large diameter cylinder to thereby prevent dripping from the nozzle and also break and string of the liquid dispensed from the nozzle.

* * * * *

UNITED STATES PATENT AND TRADEMARK OFFICE

CERTIFICATE OF CORRECTION

PATENT NO. : 4,004,717

DATED : January 25, 1977

INVENTOR(S) : William L. Wanke

It is certified that error appears in the above-identified patent and that said Letters Patent are hereby corrected as shown below:

Column 4, line 27, "and" should read -- any --.

Signed and Sealed this

Third Day of May 1977

[SEAL]

*Attest:*

RUTH C. MASON
*Attesting Officer*

C. MARSHALL DANN
*Commissioner of Patents and Trademarks*